US006766598B2

(12) United States Patent
Boncutter et al.

(10) Patent No.: US 6,766,598 B2
(45) Date of Patent: Jul. 27, 2004

(54) WATER-RESISTANT AND FLOATABLE FOOTWEAR AND METHOD OF MANUFACTURE THEREFOR

(75) Inventors: Mary K. Boncutter, Newport Beach, CA (US); Wilson Chao Nan Chen, Taichung (TW)

(73) Assignee: R & S Trading Company, Inc., Irvine, CA (US)

( * ) Notice: Subject to any disclaimer, the term of this patent is extended or adjusted under 35 U.S.C. 154(b) by 0 days.

(21) Appl. No.: 10/264,015

(22) Filed: Oct. 3, 2002

(65) Prior Publication Data

US 2003/0088998 A1 May 15, 2003

Related U.S. Application Data

(63) Continuation of application No. 09/690,552, filed on Oct. 17, 2000, now Pat. No. 6,508,016.

(51) Int. Cl.[7] ..... A43B 3/12
(52) U.S. Cl. ..... 36/11.5; 36/8.1; 36/109
(58) Field of Search ..... 36/11.5, 8.1, 109

(56) References Cited

U.S. PATENT DOCUMENTS

| | | | | |
|---|---|---|---|---|
| 1,875,162 A | | 8/1932 | Sayers | |
| 2,099,418 A | | 11/1937 | Bradley et al. | |
| 2,715,285 A | * | 8/1955 | Del Vecchio | 36/11.5 |
| 2,744,340 A | | 5/1956 | Gerber | |
| 3,352,033 A | | 11/1967 | Colley | |
| 3,596,381 A | | 8/1971 | Fukuoka | |
| 3,608,215 A | * | 9/1971 | Fukuoka | 36/29 |
| 3,675,346 A | | 7/1972 | Miyachi et al. | |
| 3,698,107 A | | 10/1972 | Fukuoka | |
| 3,698,108 A | | 10/1972 | Brunner | |
| 3,925,914 A | | 12/1975 | Marcoux | |
| 3,928,927 A | | 12/1975 | Brown et al. | |
| 3,936,896 A | | 2/1976 | Creamer | |
| 4,051,610 A | * | 10/1977 | Shigeji | 36/11.5 |
| 4,200,997 A | | 5/1980 | Scheinhaus et al. | |
| 4,279,049 A | | 7/1981 | Coiquaud | |
| 4,429,473 A | * | 2/1984 | Blumenstein | 36/11.5 |
| 4,446,633 A | * | 5/1984 | Scheinhaus et al. | 36/11.5 |
| 4,843,736 A | | 7/1989 | Courian | |
| 5,205,054 A | | 4/1993 | York, Jr. | |
| 5,230,115 A | | 7/1993 | Hollister et al. | |
| 5,367,735 A | | 11/1994 | Mosier et al. | |
| 5,802,738 A | | 9/1998 | Ferniani | |
| 5,852,885 A | | 12/1998 | Ferniani | |
| 5,992,055 A | | 11/1999 | Connor | |
| 6,003,246 A | | 12/1999 | Pan | |
| 6,004,647 A | | 12/1999 | Bambara et al. | |
| 6,014,821 A | | 1/2000 | Yaw | |
| 6,021,585 A | | 2/2000 | Cole | |
| 6,029,372 A | | 2/2000 | Pan | |
| 6,035,554 A | | 3/2000 | Duncan | |
| D429,555 S | | 8/2000 | Kelley | |
| 6,120,880 A | | 9/2000 | Crow | |
| 6,477,790 B2 | * | 11/2002 | Boncutter et al. | 36/11.5 |
| 6,508,016 B1 | * | 1/2003 | Boncutter et al. | 36/11.5 |

* cited by examiner

*Primary Examiner*—Ted Kavanaugh
(74) *Attorney, Agent, or Firm*—Christie, Parker & Hale, LLP

(57) ABSTRACT

A water-resistant and floatable footwear including an outsole and insole, an upper member affixed to the sole, wherein the footwear is floatable in water. In particular, the insole of the footwear is constructed of the material "marine buoy;" that is, the insole has an inner structure and an outer coating, the inner structure being constructed of a thermoplastic resin and the outer coating being constructed of a vinyl polymer. The footwear is advantageously water-proof and provides buoyancy in water.

20 Claims, 8 Drawing Sheets

WATER-RESISTANT AND FLOATABLE FOOTWEAR AND METHOD OF MANUFACTURE THEREFOR

CROSS REFERENCE TO RELATED APPLICATION

This is a continuation of application Ser. No. 09/690,552, filed Oct. 17, 2000 now U.S. Pat. No. 6,508,016.

FIELD OF THE INVENTION

This invention relates to footwear, in particular, lightweight and comfortable footwear providing buoyancy in water and resistance to water absorption, and a method of manufacture therefor.

BACKGROUND OF THE INVENTION

Casual and lightweight shoes, particularly, sandals are known. Many of these shoes and sandals (hereinafter collectively referred to as "footwear") are flexible due to the materials used to construct the soles. However, because many of these materials are porous, such footwear readily absorb water and become heavy and cumbersome. The absorbed moisture or liquid may seep out over time causing discomfort to the wearer, or even causing the wearer to trip or fall. Moreover, such absorption may stain the footwear or promote the growth of unsightly or odor-causing fungus To avoid some of these problems, some footwear have provided drainage holes or other drainage features which unfortunately do not prevent the absorption of water, but simply provide an outlet for the water absorbed. However, seepage is not avoided, nor is the growth of unsightly or odor-causing fungus caused by the trapped moisture.

As with recreational footwear, particularly those adapted for use in water recreation, it is desirable to have footwear that have buoyancy and float in water. It is not uncommon for a shoe or sandal to slip off one's foot while ingressing or egressing a boat. It is also not uncommon for a shoe or a sandal to fall into a swimming pool. Accordingly, footwear which stay afloat in water, while resistant to the absorption of water, provide many advantages.

Another desirable feature in footwear is comfort in the areas of direct contact with the feet. While many footwear are desirably casual and lightweight, the desire to minimize weight has left many footwear with uncomfortable inner soles that lack a liner that is both comfortable and slip-resistant.

Furthermore, current fashion trends mandate footwear to come in a wide variety of colors. It is therefore desirable therefore to provide footwear which address the foregoing problems, but also be suitable to arrive in a variety of colors. In order to meet the ever-changing tastes of the marketplace, the color of the footwear should be easily alterable.

SUMMARY OF THE INVENTION

The present invention is directed to a new and improved footwear comprising a sole including an outsole and insole, an upper member affixed to the sole, wherein said footwear is floatable in water. In particular, the insole of the footwear is constructed of the material "marine buoy;" that is, the insole has an inner structure and an outer coating, the inner structure being constructed of a thermoplastic resin and the outer coating being constructed of a vinyl polymer As such, the footwear is advantageously water-proof and provides buoyancy in water The upper members of the footwear may also be constructed of the marine buoy material and they may be configured as a continuous strap or flaps that are detachably attached to each other. The outsole of the footwear may be configured in close conformity with the insole, or it may include a peripheral border extending upwardly and around said insole.

The present invention is also directed to a method for producing a footwear with an insole, an outsole and upper members, comprising the steps of forming the outsole, forming the insole by forming an inner structure from a thermoplastic resin, immersing the inner structure in vinyl polymer, arranging the upper members relative to the insole and the outsole to form said footwear, securely affixing the insole, the outsole and the upper members to each other. A step of the method may include providing apertures in the insole adapted for securing the upper members before immersing the insole in the vinyl polymer The foregoing and other objects, features and advantages of the invention will be apparent from the following more particular description of the preferred embodiments, taken in conjunction with the accompanying drawings, which illustrate, by way of example, the principles of the invention.

DETAILED DESCRIPTION

Figure 1:
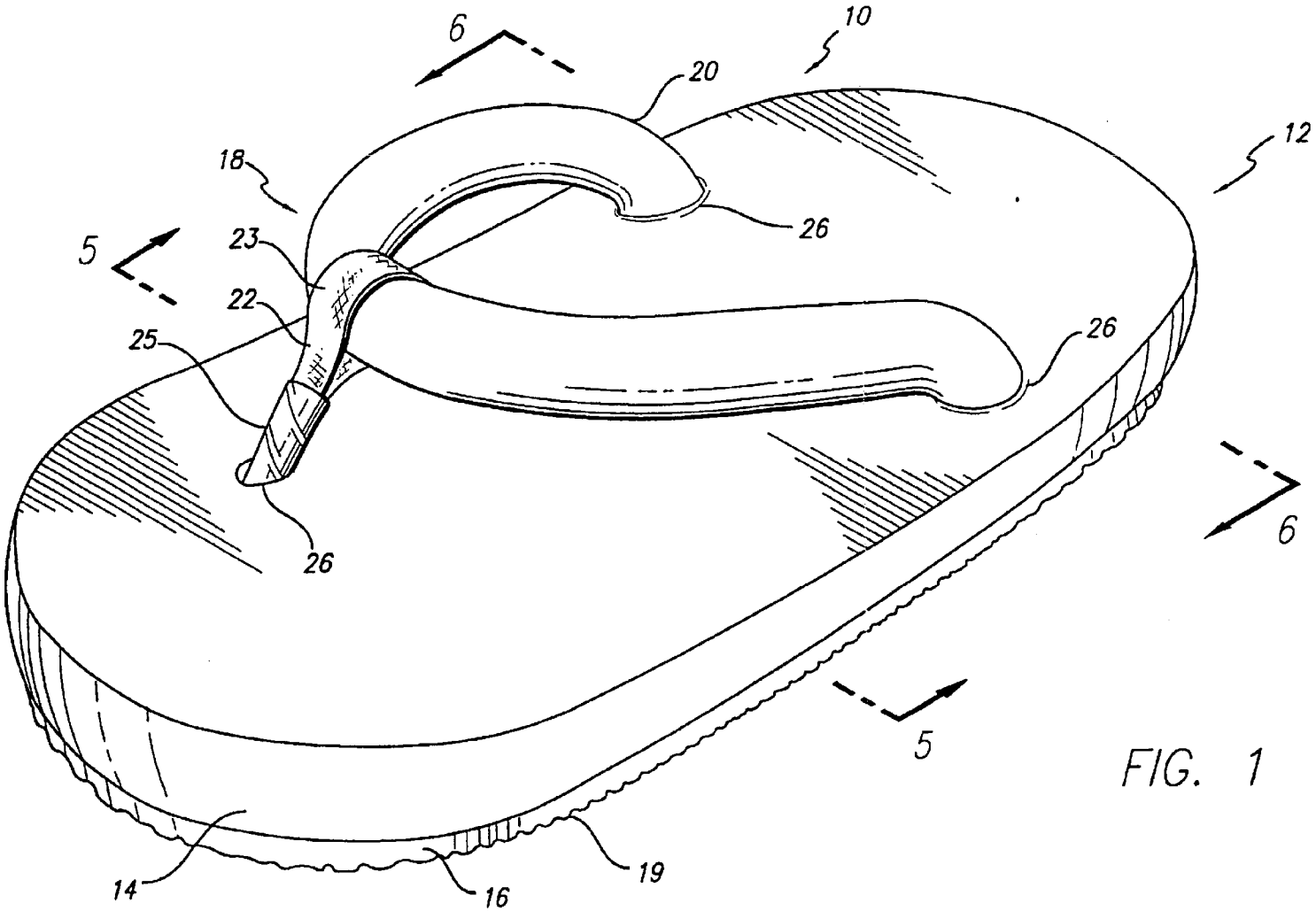
FIG. 1 is a perspective view of an embodiment of a footwear of the present invention.
Figure 2:
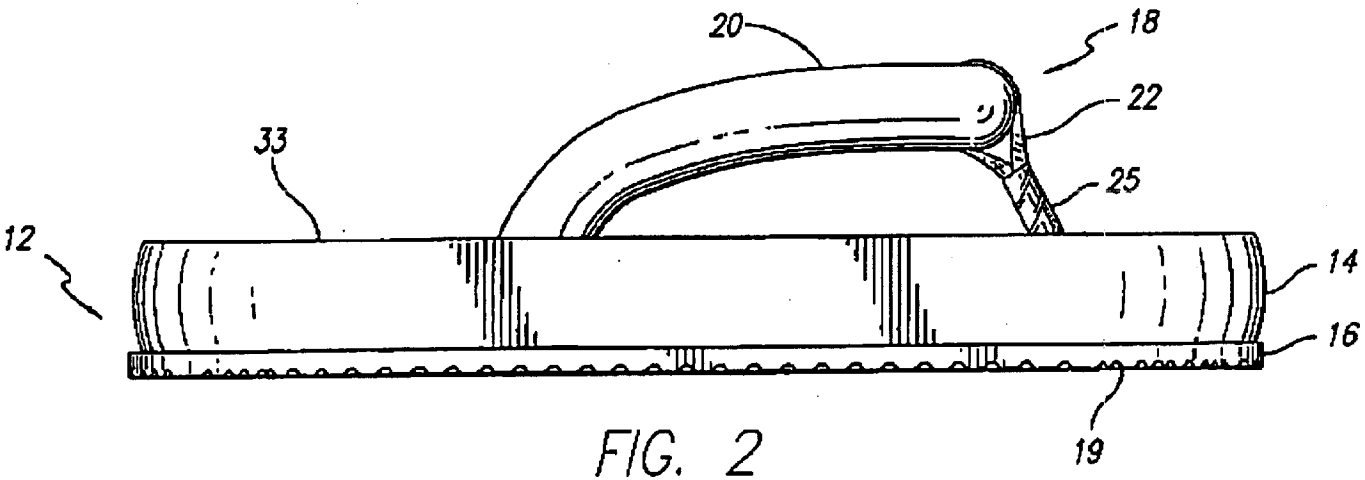
FIG. 2 is a side elevational view of the footwear of FIG. 1.
Figure 6:
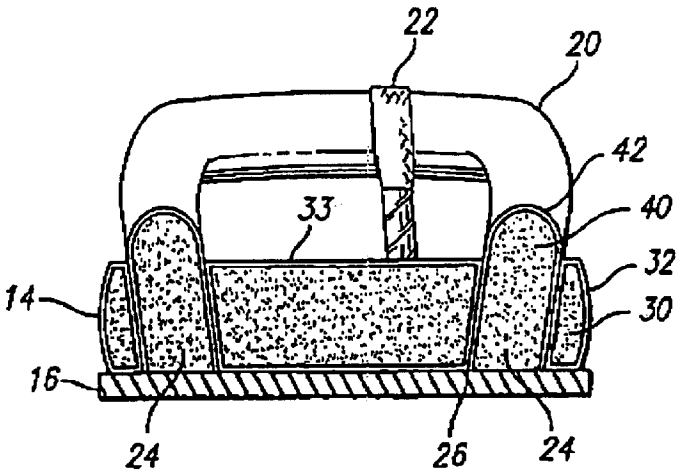
FIG. 6 is a cross-sectional view taken along line 6—6 in FIG. 1.
Figure 5:
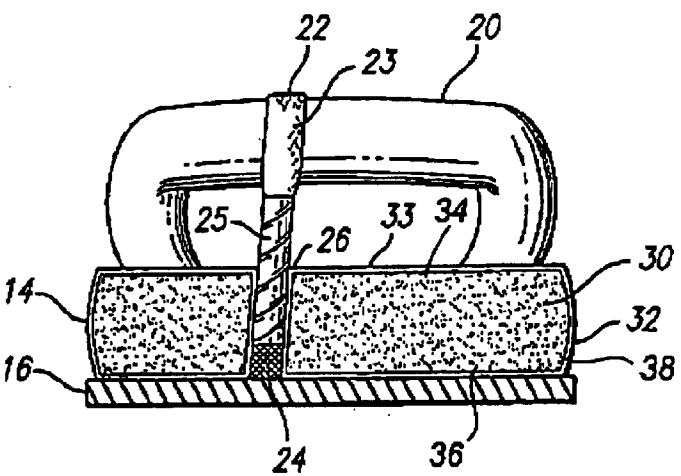
FIG. 5 is a cross-sectional view taken along line 5—5 in FIG. 1.

Referring to FIGS. 1 and 2, an embodiment of a footwear 10 of the present invention is shown. The footwear has a sole 12, including an insole 14 and an outsole 16, and upper member or members (hereinafter used interchangeably) 18 affixed to and extending above the sole 12 for securing the footwear 10 to the wearer's foot (not shown). The upper members 18 may include a strap 20 and a fastening member 22 both adapted and configured to conform to the wearer's foot. In particular, the strap 20 is configured to extend above the foot and the fastening member 22 is configured to extend between the toes of the foot. Referring to FIGS. 5 and 6, the ends 24 of the upper members of this embodiment of the footwear 10 are securely affixed to the outsole 16 by, e.g., adhesives or glue. As understood by one of ordinary skill in the art, the upper members may connected to the sole 12 by a variety of different means, including the formation of a nub at the ends 24 of the upper members which are received in appropriately-sized apertures defined in the sole 12, or other fastening or connecting structures.

Figure 3:
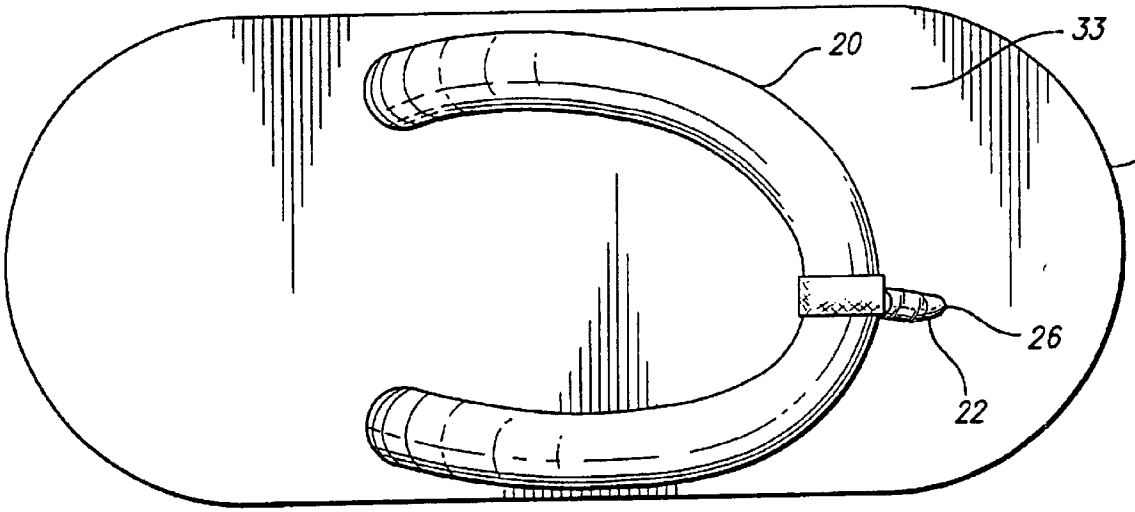
FIG. 3 is top plan view of the footwear of FIG. 1.
Figure 4:
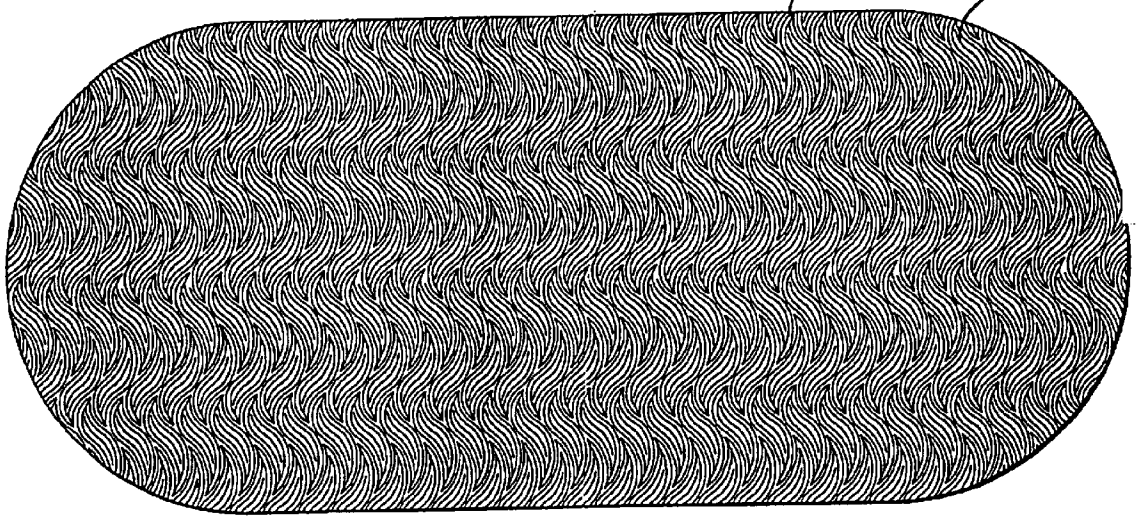
FIG. 4 is a bottom plan view of the footwear of FIG. 1.
Figure 7:
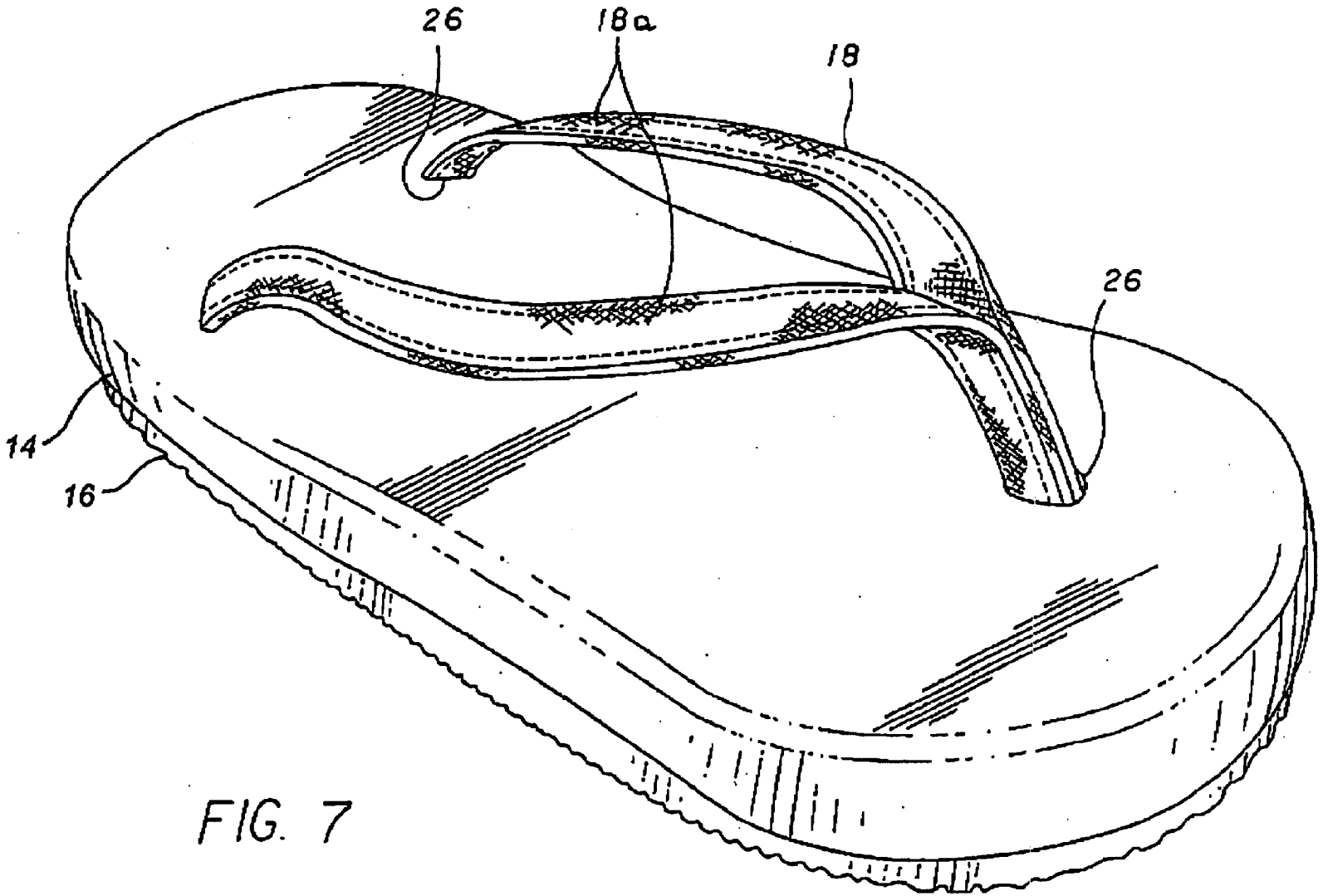
FIG. 7 is a perspective view of an alternative embodiment of the footwear of the present invention.
Figure 8:
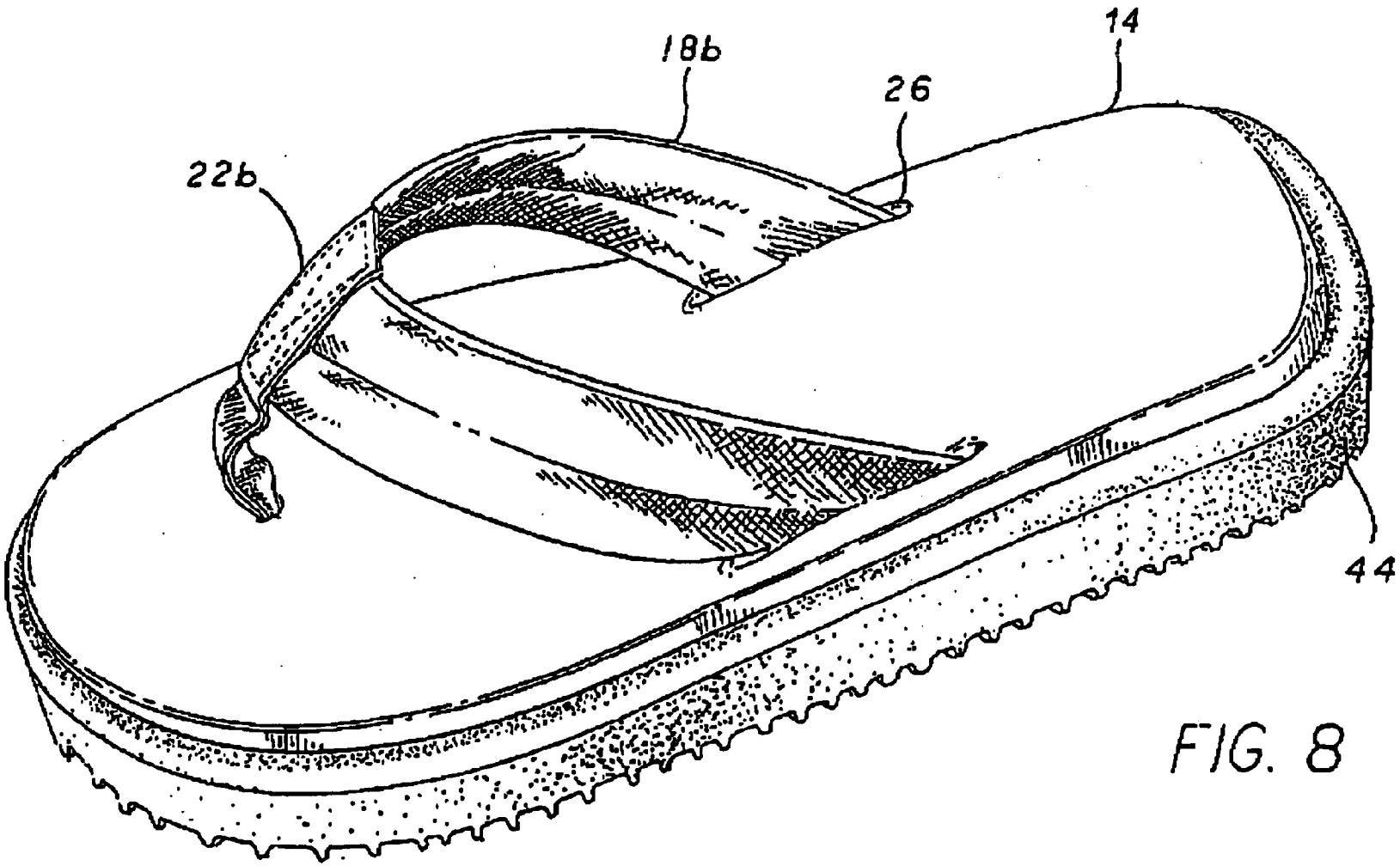
FIG. 8 is a perspective view of another alternative embodiment of the footwear of the present invention.

Referring to the embodiment illustrated in FIGS. 3 and 4, the insole 14 and the outsole 16 are made from flexible materials and are of substantially the same configuration such that their respective peripheral outer edges are substantially even with each other. The outsole 16 may be constructed of a suitably flexible, elastomeric and/or durable material for resisting wear while providing tread. Rubber, for example, may be used to construct the outsole 16. In this illustrated embodiment, the outsole 16 has a substantially uniform thickness of approximately 3/16 inch throughout the length and width of the footwear 10 (see FIG. 2). A walking surface 19 of the outsole 16 is configured with a pattern to provide tread and friction (see FIG. 4).

Referring to FIGS. 5 and 6, the insole 14 may be constructed of a combination of flexible materials commonly referred to as "marine buoy" to resist water absorption and provide buoyancy in the footwear. The insole 14 includes an inner structure 30 that may be foam-like and is at least partially, if not substantially wholly, encapsulated in a waterproof, water-repellant and/or water-resistant sealant coating 32. The inner structure 30 is compressible and of a relatively low density compared to the outsole 16, such that it cushions the foot. Suitable materials for construction of the inner structure 30 include a thermoplastic synthetic resin or a thermoplastic synthetic resin containing a plasticizer Such a suitable thermoplastic resin composition may comprise of the following:

| | |
|---|---|
| NBR (nature polybutadine rubber) | 30% |
| PVC (polyvinyl chloride paste resin) | 30% |
| Filler talc | 12% |
| Foaming agent | 10% |
| Plasticizer | 12% |
| Process oil | 6% |

The resin may be molded, trimmed, cut or otherwise configured (before, during or after curing, as understood by one of ordinary skill in the art) as desired, but preferably to conform substantially to outer shape of the foot. The thickness of the inner structure 30; however, may be as is desirable and/or functional. In a preferred embodiment, the thickness is substantially uniform throughout the length and the width of the sole 12 at approximately 1½ inches. It is understood that the thickness of the inner structure 30 may be nonuniform as desirable or appropriate to conform to the shape of the foot. The inner structure 30 has a top surface 34, a bottom surface 36 and a side surface 38 extending around the outer perimeter of the inner structure between the top and bottom surfaces.

The coating or surface 32 functions as a barrier or sealant of the inner structure 30 to the environment. As such, the coating 32 is flexible and has water-proofing, water-repelling and/or water-resistant properties. Suitable materials include vinyl polymer or vinyl co-polymer compositions (used interchangeably herein) which may be readily mixed with any of a variety of color pigments for coloring the coating 32 as desired.

As mentioned, color pigments may be added to, mixed in, and/or selected in the vinyl polymer. Accordingly, the footwear 10 may be readily manufactured in a variety of colors to suit the tastes of the marketplace without substantial changes in the manufacturing process or equipment. In that regard, the color of the insole may be selected to purposefully match or otherwise complement the color(s) of the upper members 18.

To apply the coating 32, the inner structure 30 once cured and shaped is immersed in the vinyl polymer. As such, the inner structure 30 is effectively encapsulated or sealed within an effective water-resistant, if not water-proof barrier. Moreover, the coating 32 so encapsulating the inner structure 30 provides a comfortable and slip-resistant upper surface 33 with which the foot directly contacts when the footwear 10 is worn. Once constructed, the insole 14 and the outsole 16 are securely affixed to each other and preferably by means of adhesive or glue.

The upper members 18, in particular the strap 20, may also be constructed similarly to insole 14. In that regard, as shown in FIG. 6, the strap 20 may have an inner structure 40 made of the foregoing resin and a coating 42 of vinyl polymer, whereby both the inner structure 40 and the coating 42 extend along the length of the strap 20. For the average-sized foot, the strap 20 may have a length of approximately 9.0 inches and a diameter of approximately 0.5 inches. Accordingly, the strap 20 and the insole 14 provide a comfortable contact surface for the foot, while also being water-resistant, if not water-proof, like the insole 14.

As also shown in FIGS. 1 and 5, the fastening member 22 may be a strip of woven textile 23 that is configured to provide a loop through which the strap 20 extends. A plastic or latex tube 25 may be used to secure together ends 44 of the fastening member.

As mentioned, the ends 24 of the upper members 18 are securely affixed to the sole 12 by adhesive or glue. In the illustrated embodiment of FIGS. 1, 5 and 6, apertures 26 are configured in the insole 14 to permit the ends 24 to pass through the insole 14 and come into direct contact with the outsole 16. In that regard, the apertures 26 are configured in the inner structure 30 before it is immersed in the vinyl polymer, so that the apertures are, too, provided with the coating 32.

Accordingly, the footwear of FIG. 1 may be constructed substantially by the following steps:

Step 1: providing the outsole 16;

Step 2: forming the insole 14, including preparing the resin composition and configuring it into the inner structure 30;

Step 3: immersing the inner structure 30 in the vinyl polymer to provide the coating 32;

Step 4: forming the strap 20 of the upper members 18, including preparing the resin composition and configuring it into the inner structure 40;

Step 5: immersing the inner structure 40 in the vinyl polymer to provide the coating 42;

Step 6: providing the upper members 18, including arranging the strap 20, the fastening member 22 and the tube 25 relative to each other; and Step 7: securely affixing to each other, the outsole 16, the insole 14 and the upper members 18 by adhesive or glue.

The method of the present invention may also involve the following steps:

Step 2a: forming the apertures 26 in the inner structure 30 before it is immersed in the vinyl polymer.

Moreover, Steps 4 and 5 may be bypassed if the upper members 18 are not to be constructed of the marine buoy material. It is therefore understood by one of ordinary skill in the art that the foregoing steps need not be taken in the sequence presented, nor does each step need to be taken in manufacturing the footwear 10. The method may be altered as appropriate or desired depending on the desired configuration and/or embodiments of the footwear as described further below.

Figure 11:
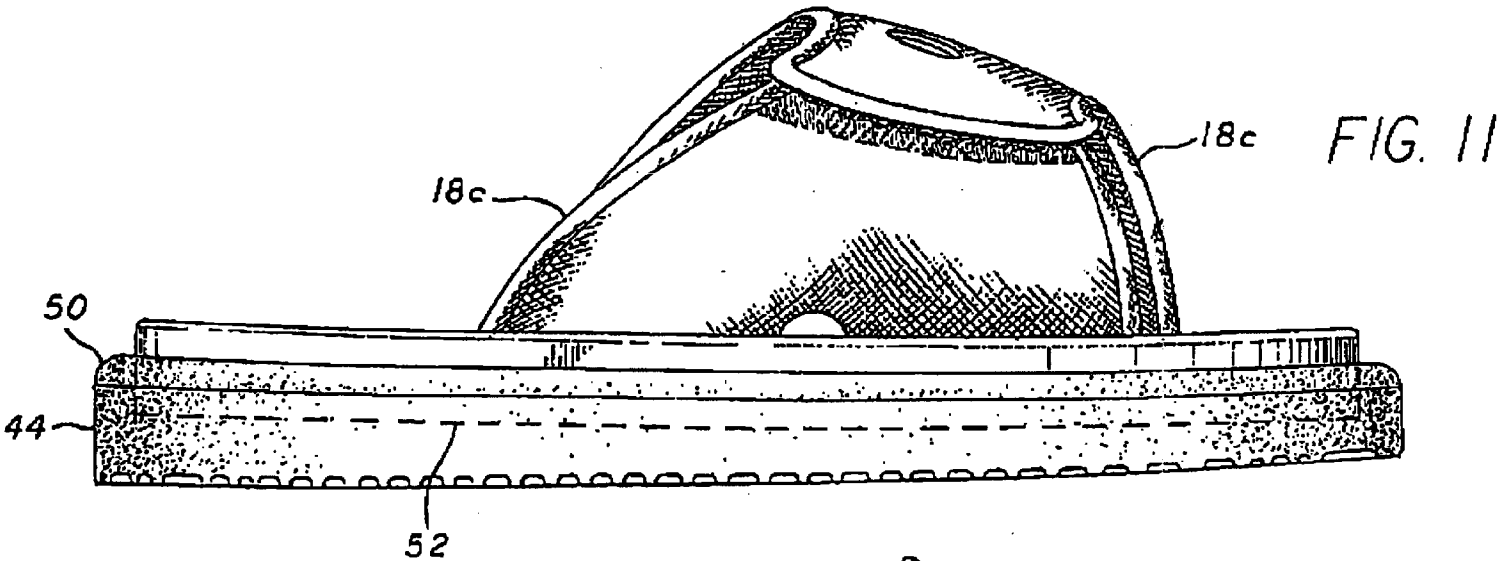
FIG. 11 is a side elevational view of the footwear of FIG. 19.
Figure 9:
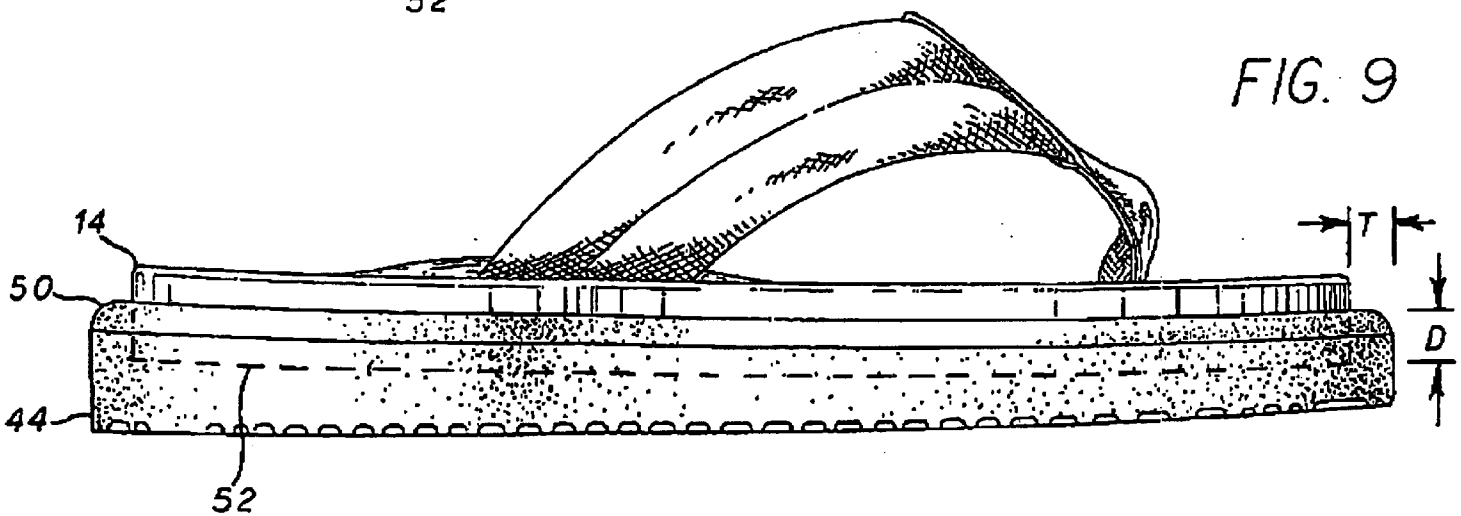
FIG. 9 is a side elevational view of the footwear of FIG. 8.
Figure 10:
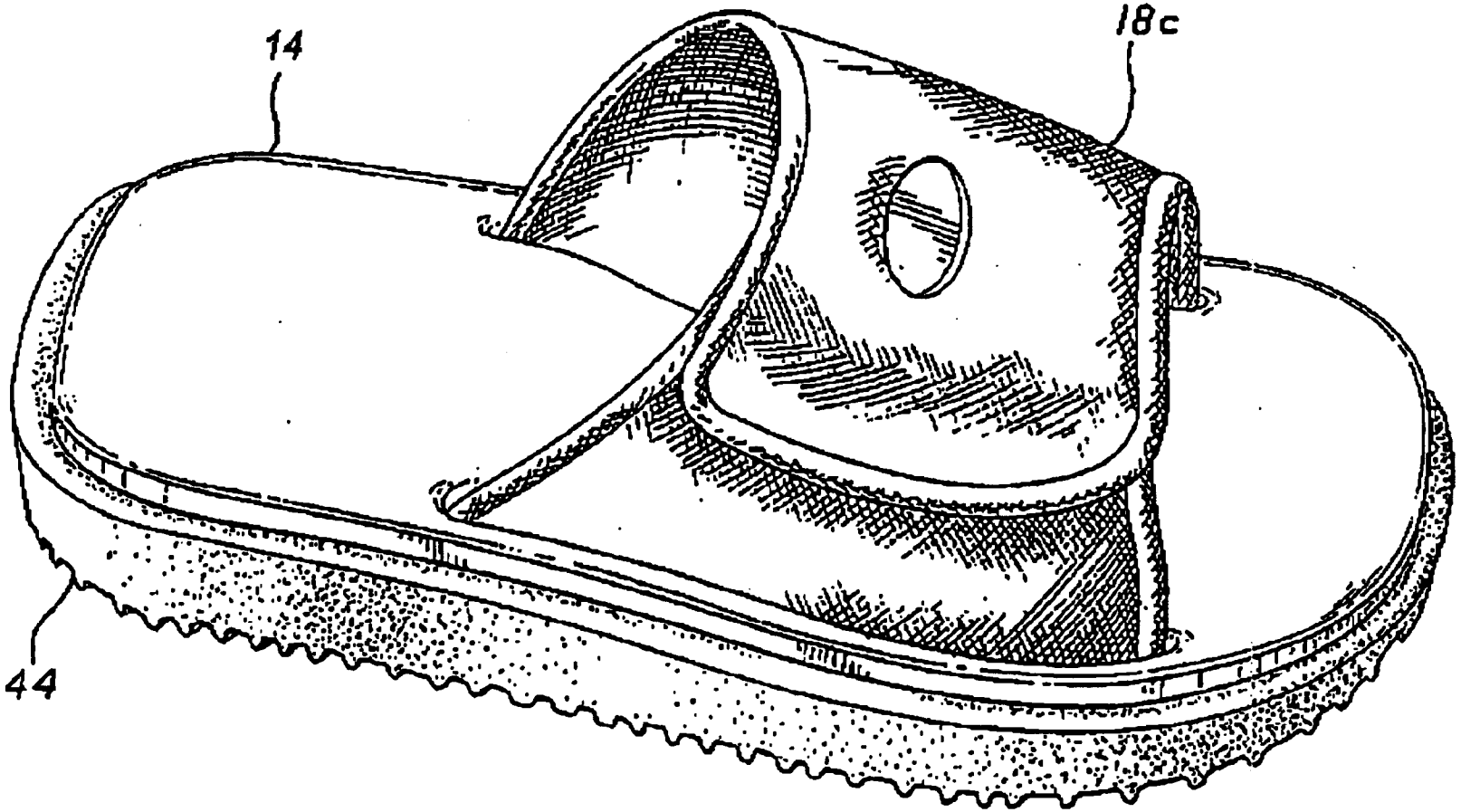
FIG. 10 is a perspective view of yet another alternative embodiment of the footwear of the present invention.
Figure 12:
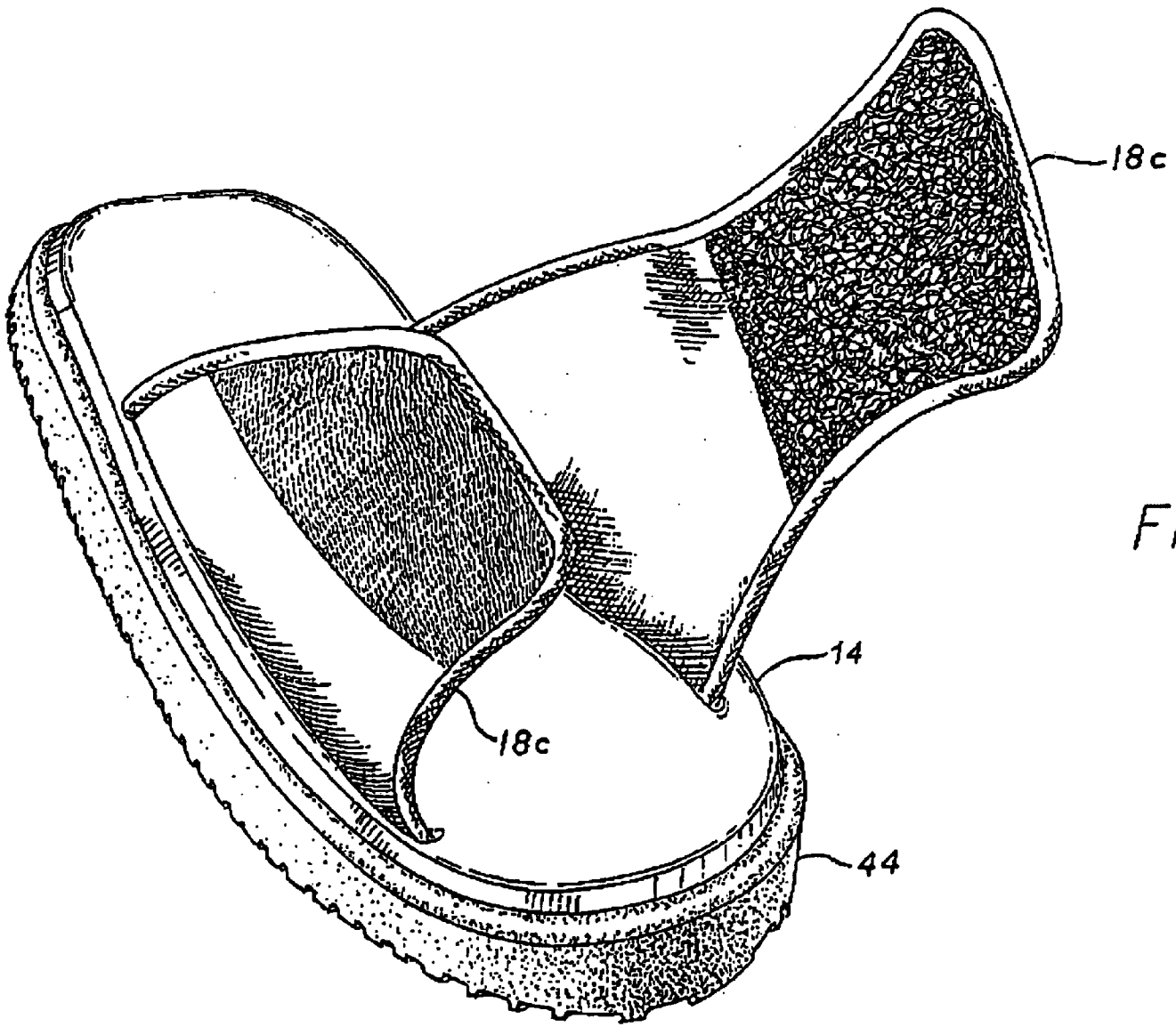
FIG. 12 is a perspective view of footwear of FIG. 10, with upper members detached from each other

As illustrated in FIGS. 7–11, the upper members 18 may adopt an unlimited number of variations in their configuration or manner of construction. The upper members 18 may take the form of two converging, relatively thin members 18*a* (FIG. 7), a continuous, wider member 18*b* in combination with a fastening member 22*b* (FIGS. 8 and 9), or even two overlapping (adjustable) flaps 18*c* that are detachable by Velcro® pads (FIGS. 10, 11 and 12). The materials of which these upper members are constructed may be man-made or otherwise, including pseudo-suede, nylon or nylon-based textiles, or the like. As illustrated, the apertures 26 (that is, the shape and size) are configured in conformity with the particular upper members 18 employed with the footwear.

As illustrated in FIGS. 8–11, the sole 12 may also adopt unlimited variations in its configuration. In these illustrated embodiments, an outsole 44 is configured to with an upwardly extending peripheral border 50 (best illustrated in FIGS. 9 and 11) surrounding the relatively lower surface 52 on which the insole 14 sits. Thus, unlike the outsole 16 of FIGS. 1–6 which is of a substantially uniform thickness, the outsole 44 provides the peripheral border 50 which may have a thickness T of approximately 5/16 inch and a depth D of approximately ¼ inch.

For these other embodiment of the footwear of the present invention, the manufacturing thereof may substantially follow the steps set forth above. Clearly, where the upper members are configured or constructed differently, the steps may be altered as appropriate or desired.

Although the foregoing discloses the presently preferred embodiments of the present invention, it is understood that the those skilled in the art may make various changes to the preferred embodiments shown and described without departing from the scope of the invention. As such, the invention is defined only by the following claims.

What is claimed is:

1. A footwear comprising:

a flexible sole including an outsole and an insole, the insole having:

a flexible inner compressible structure having a top surface, a bottom surface and a side surface extending around the outer perimeter of the inner structure between the top and bottom surfaces; and a flexible outer coating forming a continuous layer that substantially covers the entire top, bottom and side surfaces of the compressible structure; and a strap extending from the sole;

wherein the coating is a coating of vinyl polymer that forms a water barrier and the inner compressible structure is a different material than the outer coating.

2. A footwear of claim 1, wherein the inner compressible structure has a low density relative to the outsole.

3. A footwear of claim 1, wherein the strap is a separately formed member.

4. The footwear of claim 1 wherein the flexible inner compressible structure is a single layer of compressible material and the outer coating contacts the top and side surfaces of the compressible structure.

5. The footwear of claim 1, wherein the footwear is buoyant.

6. The footwear of claim 1, wherein the outsole is wear resistant relative to the insole.

7. A footwear of claim 1 wherein the inner structure is compressible compared to the outsole.

8. A footwear comprising:

a flexible sole including an outsole and an insole, the insole having:

a flexible inner compressible structure having a top surface, a bottom surface and a side surface extending around the outer perimeter of the inner structure between the top and bottom surfaces; and a flexible outer coating forming a continuous layer that substantially covers the entire top, bottom and side surfaces of the compressible structure; and a strap extending from the sole;

wherein the coating is a coating of vinyl polymer that forms a water barrier and the inner compressible structure is a thermoplastic resin.

9. A footwear of claim 8, wherein the thermoplastic resin contains plasticizer.

10. A footwear of claim 8, wherein the thermoplastic resin comprises NBR, PVC, filler talc, foaming agent, plasticizer and process oil.

11. A footwear of claim 8, wherein the inner compressible structure has a low density relative to the outsole.

12. A footwear of claim 8, wherein the strap is a separately formed member.

13. The footwear of claim 8 wherein the flexible inner compressible structure is a single layer of compressible material and the outer coating contacts the top and side surfaces of the compressible structure.

14. The footwear of claim 8, wherein the footwear is buoyant.

15. The footwear of claim 8, wherein the outsole is wear resistant relative to the insole.

16. A footwear of claim 8 wherein the inner structure is compressible compared to the outsole.

17. A footwear comprising:

a flexible sole including an outsole and an insole, the insole having:

a flexible inner compressible structure having a top surface, a bottom surface and a side surface extending around the outer perimeter of the inner structure between the top and bottom surfaces; and a flexible outer coating forming a seamless continuous layer that substantially covers the entire top, bottom and side surfaces of the compressible structure; and a strap extending from the sole;

wherein the coating is a coating of vinyl polymer that forms a water barrier and the inner compressible structure is a different material than the outer coating.

18. A footwear of claim 17 wherein the inner compressible structure is a thermoplastic resin that is compressible compared to the outsole.

19. A footwear of claim 17 wherein the inner compressible structure is a thermoplastic resin that compresses to cushion a foot of a wearer.

20. A footwear of claim 17 wherein the inner compressible structure is a thermoplastic resin that compresses to generally conform to a shape of a foot of a wearer.

* * * * *

US006766598C1

(12) EX PARTE REEXAMINATION CERTIFICATE (7807th)

United States Patent

Boncutter et al.

(10) Number: US 6,766,598 C1

(45) Certificate Issued: Oct. 12, 2010

(54) WATER-RESISTANT AND FLOATABLE FOOTWEAR AND METHOD OF MANUFACTURE THEREFOR

(75) Inventors: Mary K. Boncutter, Newport Beach, CA (US); Wilson Chao Nan Chen, Taichung (TW)

(73) Assignee: Back Beat, Inc., Irvine, CA (US)

Reexamination Request:
No. 90/007,172, Aug. 13, 2004

Reexamination Certificate for:

| | |
|---|---|
| Patent No.: | **6,766,598** |
| Issued: | **Jul. 27, 2004** |
| Appl. No.: | **10/264,015** |
| Filed: | **Oct. 3, 2002** |

Related U.S. Application Data

(63) Continuation of application No. 09/690,552, filed on Oct. 17, 2000, now Pat. No. 6,508,016.

(51) Int. Cl.
*A43B 3/12* (2006.01)

(52) U.S. Cl. ..... 36/11.5; 36/8.1; 36/109

(58) Field of Classification Search ..... 36/11.5, 36/8.1, 109
See application file for complete search history.

(56) References Cited

U.S. PATENT DOCUMENTS

| | | | | | |
|---|---|---|---|---|---|
| 2,262,680 | A | * | 11/1941 | Hosker | 36/11.5 |
| 4,069,601 | A | | 1/1978 | Robbins et al. | |
| 5,282,326 | A | * | 2/1994 | Schroer, Jr. et al. | 36/44 |
| 6,021,585 | A | * | 2/2000 | Cole | 36/11.5 |
| 6,299,817 | B1 | | 10/2001 | Parkinson | |
| 2006/0265901 | A1 | | 11/2006 | Boncutter et al. | |
| 2007/0017121 | A1 | | 1/2007 | Boncutter et al. | |

OTHER PUBLICATIONS

40 CFR–Chapter I–Part 414, Subsection 414.40, pp. 1–5, applicability; description of the thermoplastic resins subcategory; a submitted by requestor.*

Rex Durometers Comparison Chart and technical notes of Shore A and D Durometer, Rex Gauge Company, Inc, Copyright 2001, pp. 1–5 as submitted by requestor.*

Monarch Rubber Company Products sheet , pp. 1–2 as submitted by requestor.*

British Plastics Federation, Vinyls Group, pp. 1–9 as submitted by requestor.*

GE Polymerland, North America, Technical Facts/Technical tips & Case Studies, pp. 1–2 as submitted by requestor.*

Huey Long Rubber Co., Ltd., pp. 1–3 as submitted by requestor.*

Monarch rubber Company, Footwear, Rubber based, pp. 1–3 as submitted by requestor.*

EVA–Glory Industrial Co., Ltd., pp. 1–13, as submitted by requestor.*

Foam Rubber City, CLosed Cell Foam, pp. 1–2, as submitted by requestor.*

American Micro Inc., Polyethylene Foam, pp. 1–4, as submitted by requestor.*

Office Action from U.S. Appl. No. 11/336,641 mailed Aug. 12, 2008 (9 pages).

Claims 10–33 from U.S. Appl. No. 11/336,641, filed Jan. 20, 2006.

Office Action from U.S. Appl. No. 11/336,522 mailed Mar. 28, 2008 (9 pages).

Claims 26–28 from U.S. Appl. No. 11/336,522, filed Jan. 20, 2006.

* cited by examiner

*Primary Examiner*—Anthony Stashick

(57) ABSTRACT

A water-resistant and floatable footwear including an outsole and insole, an upper member affixed to the sole, wherein the footwear is floatable in water. In particular, the insole of the footwear is constructed of the material "marine buoy," that is, the insole has an inner structure and an outer coating, the inner structure being constructed of a thermoplastic resin and the outer coating being constructed of a vinyl polymer. The footwear is advantageously water-proof and provides buoyancy in water.

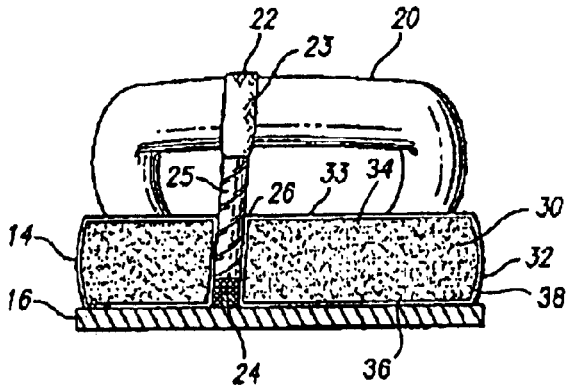

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-20 are cancelled.

* * * * *